United States Patent [19]

LeCorgne

[11] 4,009,582

[45] Mar. 1, 1977

[54] METHOD FOR FORMING DEEP CAST-IN-PLACE CASELESS CONCRETE PILES

[75] Inventor: William R. LeCorgne, New Orleans, La.

[73] Assignee: Interpile USA, Inc., New Orleans, La.

[22] Filed: Oct. 29, 1975

[21] Appl. No.: 627,012

[52] U.S. Cl. ..... 61/53.64; 264/31

[51] Int. Cl.[2] ..... E02D 5/34

[58] Field of Search ..... 61/53.64, 53.66, 53.7, 61/53.5, 53.52, 56, 56.5; 264/31

[56] References Cited

UNITED STATES PATENTS

| | | | |
|---|---|---|---|
| 1,072,491 | 9/1913 | Pierce | 61/53.64 |
| 1,883,010 | 10/1932 | Sherwood | 61/53.66 X |
| 3,851,485 | 12/1974 | Steding | 61/53.64 |

*Primary Examiner*—Jacob Shapiro
*Attorney, Agent, or Firm*—Mason, Fenwick & Lawrence

[57] ABSTRACT

A method for forming a deep cast-in-place concrete pile in the earth extending to an excessive depth by driving a hollow metallic pipe member having a height to span a substantial fraction of the design depth of the completed pile into the ground for almost its full depth, coupling a connector and hollow tubular driving mandrel to the top of the pipe section, driving the mandrel to advance the pipe section to the design depth while concurrently gravity feeding flowable concrete into the mandrel and pipe member extending therebelow, and withdrawing the mandrel leaving a monolithic concrete pile column encased by the pipe member over its lower portion.

6 Claims, 9 Drawing Figures

Fig-1-A
Fig-1-B
Fig-1-C
Fig-1-D
Fig-1-E
Fig-1-F
Fig-1-G
10
12
14
16
18
20
24
26
60' I C-1-P
60' PIPE

METHOD FOR FORMING DEEP CAST-IN-PLACE CASELESS CONCRETE PILES

BACKGROUND AND OBJECTS OF THE INVENTION

The present invention relates in general to methods and apparatus for forming deep cast-in-place concrete piles, and more particularly to methods and apparatus for forming cast-in-place concrete piles driven into the ground for greater depth than average piles, for example, in excess of 100 feet, by driving a hollow metallic pipe pile member having a height corresponding to about half the design depth of the completed pile into the ground for substantially the full depth of the pipe pile member and then assembling a hollow tubular driving mandrel to the top of the pipe pile member and driving the mandrel and pipe pile member assembled therewith to drive the pipe pile member to the design depth, in association with a transportable fill hopper by which flowable concrete is gravity fed about and into the mandrel to fill the pipe pile section and mandrel section during driving of the mandrel and thereby form a monolithic concrete cast-in-place pile.

For a long time, cast-in-place concrete piles of the type wherein a steel shell or outer casing was driven in the ground to be permanently left in the ground and concrete was thereafter poured into the steel shell to form the pile, found widespread utility in the construction field. However, because of the cost and shortage of steel, delays in securing delivery of steel casings, and related factors, efforts have been made for many years to devise effective methods of providing cast-in-place concrete piles which do not require a steel shell. Cast-in-place concrete piles which do not have such steel shells are generally termed caseless piles. The advantage to be gained by such cast-in-place caseless concrete piles lie principally in the reduction in material costs achieved by elimination of the steel shell, which is consumed in driving each pile and would not be recoverable, and avoidance of scheduling problems arising from slow steel deliveries.

One known procedure for forming caseless concrete piles which has enjoyed some success, which was devised to avoid the problems inherent in the use of cased piles, involved advancing into the soil some type of pile tip, driving foot, or boot member, achieved, for example, by use of an elongated hollow tubular driving mandrel to which the driving tip is releasably assembled, and with the use of a conventional pile driving rig, driving the mandrel and pile tip into the ground to the desired depth while continuously providing an adequate supply of flowable concrete around or within the mandrel so that the concrete can flow or be directed into the ground cavity being formed by the driving tip and mandrel. In practice, the elongated hollow tubular driving mandrel has a plurality of spaced openings in the mandrel wall through which the concrete can flow into the hollow interior of the mandrel and some type of receptacle or hopper device for containing the concrete prior to its descent into the cavity being formed by the driving tip and mandrel assembly, and for preventing unnecessary spillage, is associated with the mandrel to achieve gravity flow of the flowable concrete in the hopper into the cavity being formed by the mandrel and driving tip. The fill hoppers used in practicing this method have usually embodied shapes wherein downwardly converging planes or curvilinear surfaces are formed around the driving mandrel, and a bottom discharge hole which is only slightly larger than the diameter of the driving mandrel is provided at the bottom of the receptacle defined by the fill hopper through which the mandrel passes, so that the fill material such as flowable concrete can flow downwardly about the outer surface of the mandrel into the cavity being formed and can also flow through the holes in the mandrel wall into the interior of the mandrel. The mandrel, of course, is withdrawn from the ground after the mandrel and driving tip have been driven to the design depth for the pile, and the mandrel and hopper can then be moved to another pile site and reused with another driving tip for each additional pile to be formed.

A problem which has been encountered in putting this cast-in-place caseless pile forming method into practice has been in providing caseless concrete piles for projects requiring pile foundations with piles having a length much greater than normal pile lengths, such, for example, as projects having piles of an average length of about 120 feet or longer. Forming a cast-in-place caseless concrete pile with the mandrel and hopper equipment described above would encounter great difficulties in properly forming piles at such extreme depths, while the use of the conventional pipe pile forming methods would involve use of extremely long pipe pile sections and consume very large quantities of steel leading to great foundation costs and would require welding of pipe sections together to form the long pipe piles which introduces significant additional cost.

An object of the present invention is the provision of a novel method and apparatus for producing very deep cast-in-place concrete piles wherein a tubular metallic pile sheel or pipe having a length corresponding to a significant fraction of the total design pile length is first driven into the ground for approximately its full length and then a caseless-pile-forming mandrel is assembled thereto and positioned relative to a fill hopper to drive the assembled tubular shell and mandrel the remaining distance required to form the deep pile while gravity flowing concrete from the hopper into the mandrel and the assembled tubular shell sections to fill the same with concrete, and thereafter withdraw the mandrel, leaving a monolithic deep cast-in-place concrete pile with the lower portion thereof encased in a metallic pile shell.

Another object of the present invention is the provision of a novel method and apparatus for forming a deep cast-in-place pile wherein the pile is formed of monolithic concrete throughout its full height with the approximate lower half thereof encased in a metallic pipe or shell permitting economical and efficient formation of the deep pile beyond depths for which cast-in-place caseless concrete piles are suitable.

Other objects, advantages and capacilities of the present invention will become apparent from the following detailed description, taken in conjunction with the accompanying drawings illustrating a preferred embodiment of the invention.

DETAILED DESCRIPTION OF A PREFERRED EMBODIMENT

Figure 1:
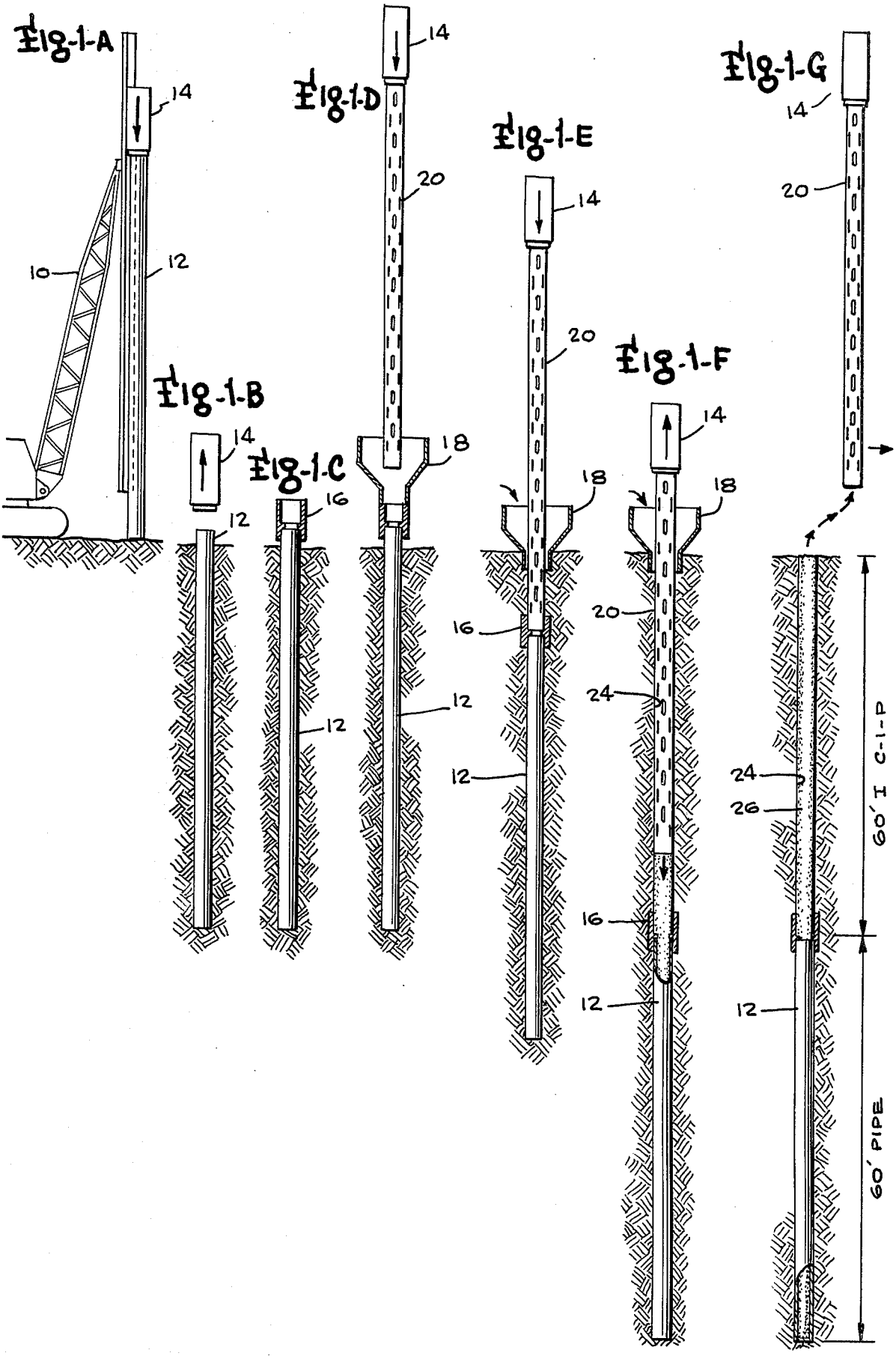
FIGS. 1-A to 1-G are diagrammatic side elevational views, partially in section, illustrating in a sequential manner the steps for forming deep cast-in-place monolithic concrete piles according to the present invention.
Figure 2:
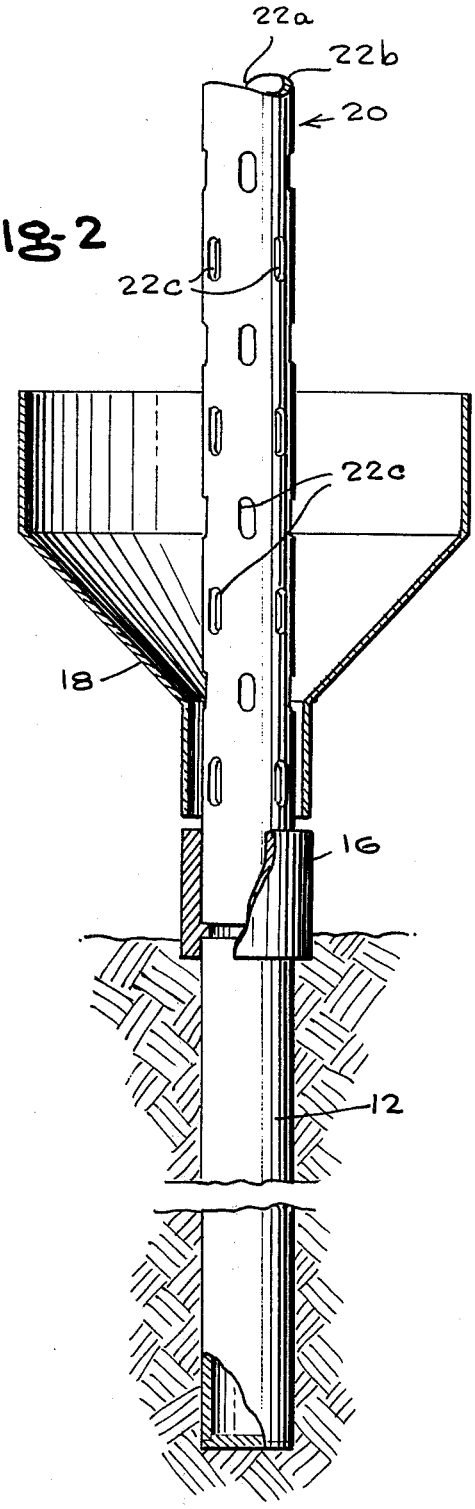
FIG. 2 is a vertical section view showing an example of the fill hopper, driving mandrel and coupling to the upper portion of the metal pipe member, which may be used in connection with practice of the present invention.
Figure 3:
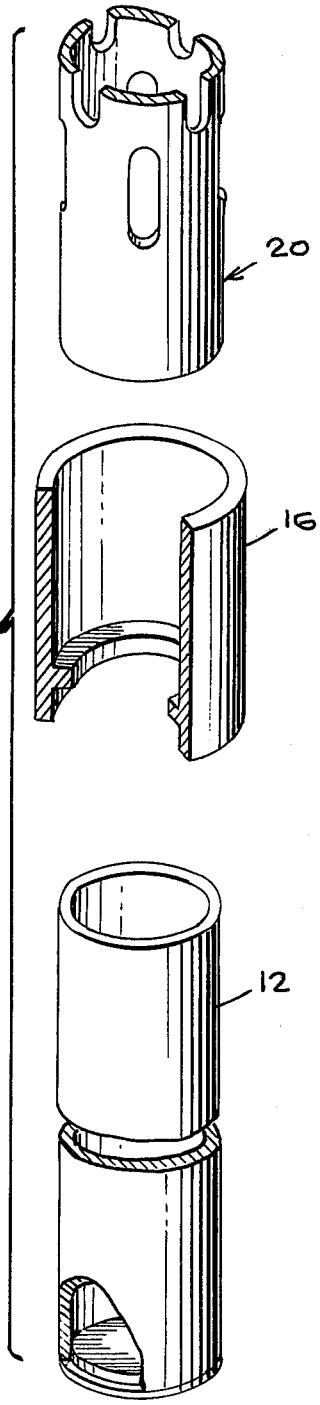
FIG. 3 is a fragmentary emploded perspective view of a connector and associated ends of the mandrel and pipe member which may be used in the practice of the present invention for assembling the lower end of the mandrel onto the upper end of the pipe member, with part of the connector broken away.

Referring to the drawings, wherein like reference characters designate corresponding parts throughout the several figures, the present invention is concerned with a method of forming deep monolithic cast-in-place concrete piles in projects requiring pile foundations which have piles of extraordinary length, usually in excess of 100 feet, such, for example, as projects requiring pile foundations where the piles have an average length of about 120 feet. It will be appreciated that projects requiring piles of such great length would normally be considered beyond the capabilities of caseless cast-in-place concrete pile systems using mandrels or pushers to form the pile cavity because of the extraordinary difficulties in trying to form pile-forming holes of such depth and then withdrawing the mandrel or pusher to produce further piles of similar depth.

The method of the present invention contemplates the use of a conventional pile forming rig together with a hollow cylindrical tubular mandrel having perforations at least in some portions of the mandrel adapted to be employed in conjunction with a fill hopper which the driven mandrel extends and which provides a receptacle for containing a quantity of flowable concrete or similar fill material to flow by gravity into the pile forming hole during a portion of the pile forming operation for producing each pile. The drive mandrel and hopper may be similar to the types disclosed in earlier U.S. Pat. Nos. 3,851,484 or 3,851,485 granted Dec. 3, 1974 to Jerry A. Steding or similar to the constuction illustrated in my earlier co-pending U.S. patent application Ser. No. 491,481 filed July 22, 1974. While the previously mentioned perforated hollow cylindrical driving mandrel or pusher and hopper equipment is used in forming a portion of the pile in accordance with my method, such equipment is only used in a second stage of the deep pile formation to produce approximately the upper half of the pile in accordance with the method described in the prior Steding patents or my previously mentioned earlier co-pending patent application. In practicing my method to provide deep piles, having, for example, an average length of about 120 feet, a driving mandrel or pusher is employed which, in one example, has a length slightly greater than one-half the design depth of the deep pile, and a steel pipe forming an open cylindrical casing of a selected diameter, for example, either ten or 12 inches in diameter, and having a length equal to about half the length of the total pile depth, is employed in the initial or first stage of the pile forming operation for each such deep pile.

In the practice of the method of forming deep piles in accordance with the present invention, and referring to the drawings, a pile driving rig such as indicated generally by the reference character 10 is properly positioned relative to the pile site, and a closed bottom steel pipe pile section, indicated by the reference character 12, such as is customarily employed in forming conventional pipe piles, but having a diameter of either 10 or 12 inches, in the illustrated embodiment, and a length of 60 feet, is assembled to the driving head 14 of the pile driving rig and is driven unfilled to a depth which would leave one or two feet of the pipe 12 protruding about the ground surface, to the condition illustrated in FIG. 1-B. The pile driving head 14 is then decoupled from the unfilled pipe section or unfilled open cylindrical casing section 12, after which the pile driving contractor may either elect to move the pile driving rig to the other positions on the job site to drive additional pipe sections 12 in the same manner for the additional piles of the project, or he may proceed through the second stage to complete the remainder of the pile driving operation for the first pile to be formed by the steel pipe section 12 already driven into the ground. In either event, when it is desired to proceed through the second stage to the completion of the deep pile, a collar or coupling adapter 16, which could be made for example of a 14 inch length section of pipe having an inside diameter equal to or slightly larger than the outside diameter of the unfilled hollow pipe section 12, is assembled to the exposed protruding top portion of the already driven pipe section 12. The coupling adapter 16 may, if desired, be welded to the pipe section 12 or merely placed over the top of the pipe section and assembled thereto with a mechanical collar. In either event, after the coupling adapter is assembled to the pipe section 12, a fill hopper 18 is then positioned over or around the coupling device 16. The fill hopper 18 may be of the types disclosed in the two above-mentioned patents of Jerry A. Steding or in my prior co-pending patent application, or may be of the sinking hopper type disclosed in earlier co-pending application Ser. No. 597,089 filed July 18, 1975 by Luis Poma and assigned to the owner of the present application. Such fill hoppers may be broadly described in an upwardly opening receptacle device usually having inclined side walls over at least the lower half of the fill hopper forming downwardly and inwardly convergent sloping walls extending to a bottom discharge opening in the hopper of a somewhat greater diameter than the diameter of the pusher or drive mandrel to be used therewith, controlled in some cases by some kind of closeable gate, so that a fill material such as flowable concrete may be gravity fed downwardly through the bottom opening into the pile cavity being formed in the earth during the pile forming operation. Such fill hoppers may be either simply placed upon the ground at the pile driving site, or may be provided with skirt or collar extensions which depend below the opening defined at the bottom of the sloping walls of the fill hopper so as to enter the hole which will be formed upon driving of the mandrel into the ground and thereby form a seal at the ground level preventing unwanted spillage of concrete during driving of the hole for the caseless pile.

A mandrel, such as is indicated at 20 in FIGS. 1-D to 1-G is then positioned through the bottom discharge opening in the hopper and into the coupling adapter or connecting device 16 whereby the lower end of the driving mandrel either abuts against, and in the illustrated embodiment is coextensive in cross section with, the upper end of the pipe section 12 which has already been driven in the ground substantially to its full depth or abuts against annular wall portions of the coupling device for transferring driving force through the coupling device to the pipe section 12. In the illustrated embodiment, the driving mandrel 20 is an elongated hollow cylindrical pipe section having an axial hollow bore or center opening 22*a* surrounded by a cylindrical outer wall 22*b*, which may be about one inch thick for a driving mandrel of 10 or 12 inches outer diameter, and which is provided with a plurality of openings or apertures 22*c* which may be, for example, circular or oval in configuration, disposed at spaced locations in the cylindrical pipe wall 22*b*. It will be appreciated, however, that the cross sectional configuration of the mandrel need not be of an annular circular cross section as shown in the illustrated embodiment, but may be a rectangular tubular configuration with right angular or rounded corners or may be of other desired cross sectional configurations providing appropriate rigidity. The cross sectional configuration of the drive mandrel is chosen in any event so that the total cross sectional area of the material forming the mandrel wall or the body of the mandrel is much less than the cross sectional area of the pile hole or cylindrical bore which will be formed in the earth during the driving of the drive mandrel so that pile forming material, such as concrete or the like, can readily flow by gravity from the hopper through the holes of the mandrel when they reach the level of the fill material in the hopper or through the void portions of the mandrel as they become aligned with the fill material in the hopper, enabling the material to gravity flow into the area outwardly surrounding the wall or walls of the driving mandrel and into the hollow interior thereof if a hollow mandrel configuration is employed.

In any event, after assembly of the connecting device or coupling adapter 16 to the exposed upper end of the already driven pipe section 12 and interfitting of the mandrel 20 into the connecting device 16 appropriately positioned relative to the fill hopper 18, the driving mandrel or pusher 20 is advanced downwardly by the driving head of the driving rig to continue forcing the pipe section 12 releasably assembled with the driving mandrel into the ground until the lower end of the pipe section 12 is driven to the desired design depth. As the mandrel 20 descends to a level immersing the perforations in the wall of the mandrel in the fill material in the hopper 18, the fill material flows into the hollow interior of the mandrel and down into the hollow interior of the pipe section 12 to fill the pipe section 12 as well as the portion of the drive mandrel which has penetrated into the earth. Additional fill material may flow downwardly along the outer surface of the driving mandrel in the space between the driving mandrel and the fill hopper wall portion surrounding the discharge opening. When the mandrel 20 has been driven to an appropriate depth to provide a pile-forming hole or cavity, indicated at 24 in the FIG. 1-F, above the steel pipe section 12 adequate to provide a total pile height equal to the desired deep pile dimension, and flowable concrete has been flowed into the pile cavity to completely fill the same, the driving mandrel 20 is then withdrawn from the opening by the driving rig, as indicated diagrammatically in FIG. 1-G, and the process of forming the cast-in-place caseless concrete pile portion with the driving mandrel and fill hopper is repeated for the remaining deep piles by successively assembling the fill hopper over the coupling devices for the other pipe sections and inserting the drive mandrel in the coupling device and repeating the caseless pile-forming operation.

In the illustrated example, where the design depth for the deep piles is an average length of about 120 feet, and the pipe pile sections 12 which are driven during the first stage of the pile-forming operation are 60 feet in length, the 120 foot pile can be readily formed with a mandrel about 65 feet long. The resultant deep pile, indicated generally at 26, will then be a 120 foot pile in which the lower 60 feet is a pipe section formed of a steel pipe 12 filled with concrete and the upper 60 feet is formed as a caseless cast-in-place concrete pile section produced with the driving mandrel 20 and fill hopper 18, but wherein the concrete filling the lower pipe section forms a monolithic pile 26 with the caseless cast-in-place concrete in the upper section so that a monolithic cast-in-place concrete pile, forming one continuous column of concrete which was poured at one time, results from this method.

This method of forming deep piles having a continuous monolithic column of concrete poured at a single time is significantly more economical than attempting to form a deep pile by assembling two pieces of pipe pile together to form one long pipe pile, since in the latter case such pipe pile sections must be welded together in the field after the first section has been driven into the ground, resulting in a very expensive and difficult-to-accomplish operation because the second section of pipe must be held in the air while it is welded to the first section. Thus the method of the present invention for forming deep cast-in-place concrete realizes significant economies over other theoretical methods of assembling preformed pile sections together to form deep piles.

What is claimed is:

1. The method of forming a deep cast-in-place monolithic concrete pile having a predetermined diameter along its entire length, and a long design depth of earth penetration, comprising the steps of first driving a closed bottom hollow rigid cylindrical metallic pipe pile section having an axial length to span a substantial fraction of said design depth and an outer diameter substantially corresponding to said predetermined diameter into the earth at the pile site to a depth approximating the axial length of the pipe pile section and leaving a short exposed top portion of said pipe pile section at the earth surface, coupling to said exposed top portion in axially aligned relation therewith an elongated driving mandrel to dispose the mandrel in vertically aligned driving relation to the pipe pile section, driving the mandrel into the earth to drive said pipe pile section a further distance into the earth approximating the mandrel length to a depth disposing the lower end of the pipe pile section at said design depth while concurrently forming a caseless pile-molding cavity in the earth encircling and axially coextensive with the portion of the mandrel driven into the earth, the mandrel having a cross sectional configuration that affords a large void area defining uninterrupted flow channels along the mandrel portion within said cavity communicating with the hollow interior of the pipe pile section for flow of flowable concrete through said flow channels and into the pipe pile section interior, concurrently gravity feeding flowable concrete downwardly into said flow channels defined within said cavity and into the hollow interior of the pipe pile section communicating therewith during driving of the mandrel to form a column of concrete extending the full height of the pipe pile section and pile-molding cavity, and withdrawing the driving mandrel from the cavity before any concrete therein has set sufficiently such that mandrel withdrawal would damage the concrete, thereby leaving a cast-in-place monolithic concrete pile column extending throughout the cavity and the interior of the pipe member.

2. The method of forming a deep cast-in-place monolithic concrete pile as defined in claim 1, wherein said mandrel is of hollow tubular configuration having a plural apertured tube wall surrounding the hollow mandrel interior for flow of concrete through the apertures of the tube wall into the interior of the mandrel and the interior of the pipe member.

3. The method of forming a deep cast-in-place monolithic concrete pile as defined in claim 2, wherein the hollow tubular cylindrical driving mandrel has inner and outer diameters which are substantially uniform from bottom to top and correspond to the inner and outer diameters of the pipe pile section.

4. The method of forming a deep cast-in-place monolithic concrete pile as defined in claim 2, including the step of locating a contained supply of flowable concrete in outwardly surrounding relation with portions of the mandrel at and immediately above the earth surface at the pile site adjacent its coupling with the pipe pile section at the commencement of driving of the mandrel into the earth and placing said contained supply of flowable concrete in communication with the hollow interior of the mandrel through the apertures in the tube wall during driving of the mandrel for gravity flow of the concrete downwardly to fill the communicating interiors of the mandrel and pipe pile section.

5. The method of forming a deep cast-in-place monolithic concrete pile as defined in claim 3, including the step of locating a contained supply of flowable concrete in outwardly surrounding relation with portions of the mandrel at and immediately above the earth surface at the pile site adjacent its coupling with the pipe pile section at the commencement of driving of the mandrel into the earth and placing said contained supply of flowable concrete in communication with the hollow interior of the mandrel through the apertures in the tube wall during driving of the mandrel for gravity flow of the concrete downwardly to fill the communicating interiors of the mandrel and pipe pile section.

6. The method of forming a deep cast-in-place monolithic concrete pile as defined in claim 2, including the steps of locating a mobile hopper having a bottom opening sized to correspond substantially to the desired pile cavity diameter and downwardly convergent sloping sides converging substantially to said opening over the pile site, vertically aligning the bottom opening of the hopper with the center axis of the pile cavity to be formed and in encircling relation to the exposed top portion of the pipe pile section before coupling the mandrel to said exposed top portion, feeding flowable concrete adequate to form the deep pile in the hopper, and gravity feeding the flowable concrete from the hopper into the flow channels in the pile-molding cavity formed during driving of the mandrel to flow the concrete from the hopper into the pile-molding cavity and the hollow interior of the pipe pile section concurrently with the driving of the mandrel.

* * * * *